US007078139B2

(12) United States Patent
Yokota et al.

(10) Patent No.: US 7,078,139 B2
(45) **Date of Patent: *Jul. 18, 2006**

(54) ELECTROPHOTOGRAPHIC PHOTORECEPTOR FOR WET DEVELOPMENT

(75) Inventors: Saburo Yokota, Suwon-si (KR); Hwan-koo Lee, Suwon-si (KR); Kyung-yoi Yon, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 190 days.

This patent is subject to a terminal disclaimer.

(21) Appl. No.: 10/680,421

(22) Filed: Oct. 8, 2003

(65) Prior Publication Data

US 2004/0137345 A1 Jul. 15, 2004

(30) Foreign Application Priority Data

Oct. 9, 2002 (KR) ..... 10-2002-0061492

(51) Int. Cl.
*G03G 5/047* (2006.01)

(52) U.S. Cl. ..... 430/58.25; 430/58.65; 430/59.6; 430/66; 399/159

(58) Field of Classification Search ..... 430/58.25, 430/58.65, 59.6, 66; 399/159
See application file for complete search history.

(56) References Cited

U.S. PATENT DOCUMENTS 5,368,967 A 11/1994 Schank et al.
6,884,559 B1 * 4/2005 Yokota ..... 430/117

FOREIGN PATENT DOCUMENTS

JP 8-272126 10/1996

OTHER PUBLICATIONS

THOMAS machine-assisted translation of JP 8-262751 (pub Oct. 1996).*

* cited by examiner

*Primary Examiner*—John L Goodrow
(74) *Attorney, Agent, or Firm*—Staas & Halsey LLP

(57) ABSTRACT

An electrophotographic photoreceptor for wet development including an electrically conductive substrate, and an organic photosensitive layer formed on the electrically conductive substrate, wherein a surface layer of the organic photosensitive layer includes at least a binder resin comprising a polymer compound and a charge transport material comprising a low molecule compound, the surface layer having an oxygen gas permeation coefficient of $5\times10^{-13}$ $cm^3$ (STP)*cm/s*$cm^2$*cmHg or less. The electrophotographic photoreceptor has high durability for liquid developer used in a wet development technique and can produce good image characteristics.

24 Claims, 1 Drawing Sheet

ELECTROPHOTOGRAPHIC PHOTORECEPTOR FOR WET DEVELOPMENT

CROSS-REFERENCE TO RELATED APPLICATIONS

This application claims the benefit of Korean Patent Application No. 2002-61492, filed on Oct. 9, 2002, in the Korean Industrial Property Office, the disclosure of which is incorporated herein by reference.

BACKGROUND OF THE INVENTION

1. Field of the Invention

The present invention relates to an electrophotographic photoreceptor for wet development, and more particularly, to an electrophotographic photoreceptor having high durability for liquid developer and good image characteristics.

2. Description of the Related Art

In electrophotography, a wet development technique using liquid developer has been known for some time, as disclosed in U.S. Pat. Nos. 2,907,674 and 3,337,340. However, since it is necessary to suppress odors emanating from a paraffinic solvent, a main component of a liquid developer, and to take fire prevention measures, a wet development technique is not widely employed. Instead, a dry development technique using a powdered developer has been generally recognized as a representative technique in electrophotography.

In wet development, since toner particles can have submicron diameters, images having high resolution are more easily obtained. Due to such an advantage, this technique is attracting public attention once again. Conventionally, an inorganic photoreceptor, e.g., amorphous selenium, has been used as an electrophotographic photoreceptor for wet development, and there has been no problems encountered with the use of inorganic photoreceptors. However, substantial problems have been encountered with the use of organic photoreceptors.

An organic photoreceptor generally includes a charge transport layer comprising a solid solution containing a binder resin, such as a polycarbonate resin or an acrylic resin, and a charge transport material, which is a low molecular compound, such as a surface layer. These resins have, a tendency of being penetrated by aliphatic hydrocarbon solvents, and the charge transport material being soluble in the solvent. Liquid developers generally include a dispersion of colorant particles in an aliphatic hydrocarbon solvent. Thus, when the liquid developer contacts an organic photoreceptor, the resin or other photoreceptor components may erode by the solvent, resulting in cracking, lower sensitivity or contamination of the developer by the eluted photoreceptor components. To overcome such problems, research and development of organic photoreceptors having high durability against liquid developers are underway, including the following methods:

(1) Polymerization of charge transport materials to prevent elution;

(2) Formation of a surface protection layer having good developer resistance to prevent a solvent from penetrating into a photosensitive layer; and (3) Increasing developer resistance of a resin to prevent a solvent from penetrating into a photosensitive layer.

The prior art related to the first method is described, for example, in U.S. Pat. No. 5,030,532. However, a polymeric charge transport material having high solvent resistance is limited in the kind thereof and general-purpose resins cannot be used, resulting in a considerable increase in the cost of raw materials.

The prior art related to the second method is described, for example, in U.S. Pat. No. 5,368,967. However, according to this technique, the manufacturing process of a photoreceptor is complicated. Also, in order to prevent deterioration of photoreceptor characteristics, a surface protection layer has to be formed as thinly as possible, which may cause lower durability.

The prior art related to the third method is described, for example, in U.S. Pat. No. 5,545,499. However, it is quite difficult to attain solvent resistance of a photoreceptor by using a binder resin having increased developer resistance alone, which is not yet put into practice.

SUMMARY OF THE INVENTION

According to an aspect of the present invention there is provided an electrophotographic photoreceptor for wet development having high durability for liquid developer used in a wet development technique and producing good image characteristics.

Additional aspects and advantages of the present invention will be set forth in part in the description which follows and, in part, will be obvious from the description, or may be learned by practice of the invention.

According to an aspect of the present invention there is provided an electrophotographic imaging apparatus comprising the electrophotographic photoreceptor.

In an aspect of the present invention, there is provided an electrophotographic photoreceptor for wet development comprising: an electrically conductive substrate: and an organic photosensitive layer formed on the electrically conductive substrate, wherein a surface layer of the organic photosensitive layer includes at least a binder resin comprising a polymer compound and a charge transport material comprising a low molecule compound, the surface layer having an oxygen gas permeation coefficient of $5\times10^{-13}$ $cm^3$ (STP)*cm/s*$cm^2$*cmHg or less.

The binder resin is preferably formed of a polymer compound having a biphenylfluorene unit represented by Formula 1 in its main chain:

<Formula 1>

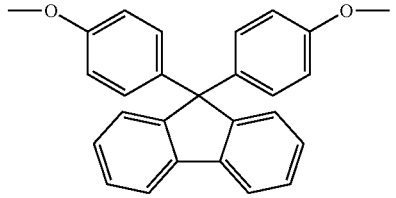

wherein at least one hydrogen atom of the benzene ring can be substituted by an arbitrary substituent selected from the group consisting of a halogen atom, a C1~C20 alkyl group and a C5~C8 cycloalkyl group.

The charge transport material preferably includes a hole transport material represented by Formula 2:

<Formula 2>

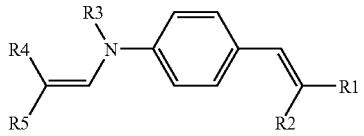

wherein R1 through R5 are independently selected from the group consisting of a hydrogen atom, a C1~C30 substituted or unsubstituted alkyl group, a C6~C30 substituted or unsubstituted aryl group, a C1~C30 substituted or unsubstituted alkoxy group, and a C8~C30 substituted or unsubstituted styrile group, and the hydrogen atom in the benzene rings can be substituted by an arbitrary substituent.

The charge transport material preferably includes an electron transport material represented by Formula 3:

<Formula 3>

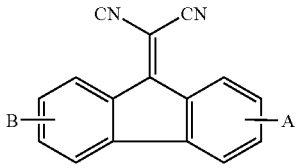

wherein A and B are independently selected from the group consisting of a hydrogen atom, a halogen atom, a C2~C30 substituted or unsubstituted alkoxycarbonyl group and a C2~C30 substituted or unsubstituted alkylaminocarbonyl group, and at least one hydrogen atom in the benzene rings can be substituted by a halogen atom.

The proportion of the binder resin in the surface layer is preferably 60~90% by weight.

The polymer compound is a polyester resin represented by Formula 4, 5, 6 or 7:

<Formula 4>

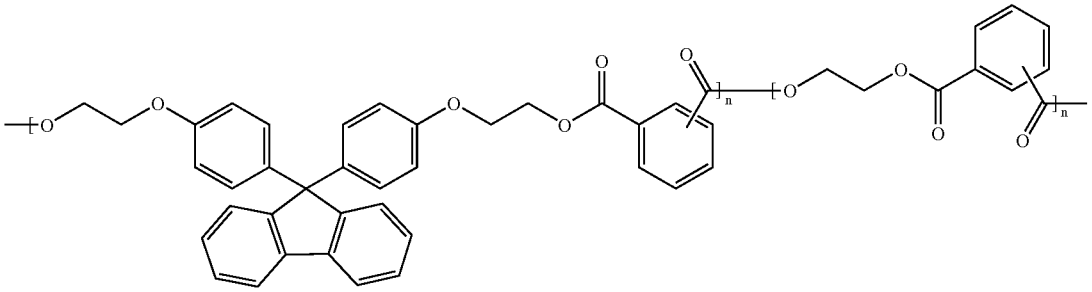

<Formula 5>

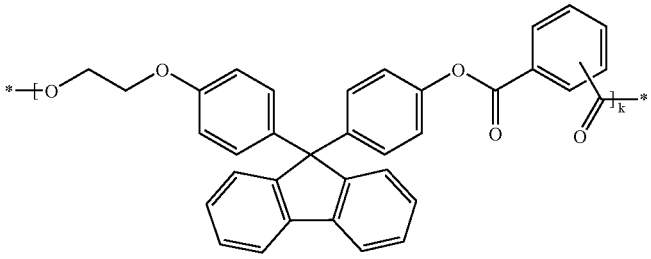

<Formula 6>

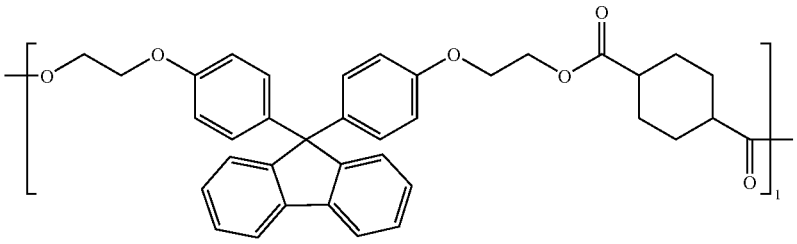

<Formula 7>

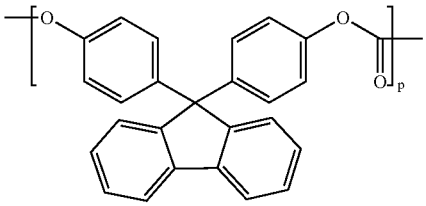

wherein k, l, m, n and p each are independently an integer between about 10 and about 1000.

Also, the electrophotographic photoreceptor according to the present invention may further include an intermediate layer for enhancing bonding strength of the photosensitive layer to the substrate or preventing charge injection from the electrically conductive substrate, between the electrically conductive substrate and the photosensitive layer.

In another aspect of the present invention, there is provided an electrophotographic imaging apparatus comprising a developing unit utilizing liquid developer, wherein the liquid developer is able to directly contact the surface of an electrophotographic photoreceptor comprising an organic photosensitive layer formed on an electrically conductive substrate, wherein a surface layer of the organic photosensitive layer includes at least a binder resin comprising a polymer compound and a charge transport material comprising a low molecule compound, the surface layer having an oxygen gas permeation coefficient of $5\times10^{-13}$ $cm^3$ (STP) *cm/s*$cm^2$*cmHg or less.

The electrophotographic photoreceptor for wet development according to the present invention exhibits high durability for liquid developer used in a wet development technique and can produce good image characteristics.

The electrophotographic photoreceptor may be implemented in an electrophotographic cartridge, an electrophotographic drum and/or an image forming apparatus.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
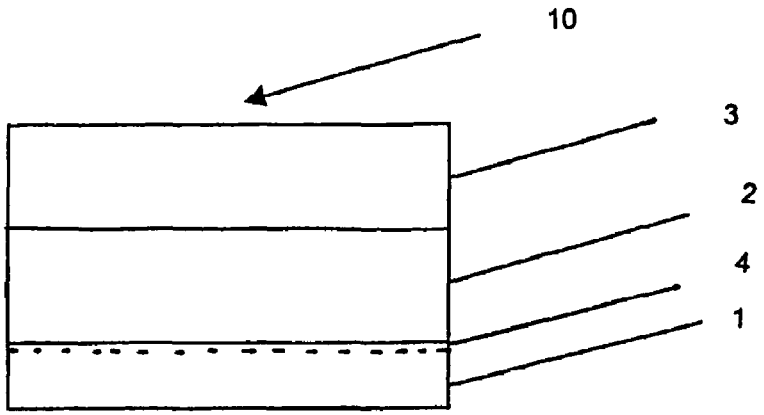
FIG. 1 is a block diagram illustrating (not to scale) an electrophotographic photoreceptor comprising an organic photosensitive layer formed on an electrically conductive substrate, in accordance with an embodiment of the present invention.

Reference will now be made in detail to the aspects of the present invention, examples of which are illustrated in the accompanying drawings, wherein like reference numerals refer to like elements throughout. The aspects are described below in order to explain the present invention by referring to the figures.

An electrophotographic photoreceptor for wet development according to the present invention and a manufacturing method thereof will now be described in more detail.

In the present invention the deterioration mechanism of an organic photoreceptor in a wet development technique has been studied and it has been found that permeability of a surface layer with respect to a particular gas is an important factor in the deterioration of a photoreceptor. Therefore, a photoreceptor having high developer resistance can be obtained by controlling the permeability of the surface layer.

Since a binder resin itself is substantially insoluble in a liquid developer, cracking or elusion of a charge transport agent occurring when there is contact between a photosensitive layer and a liquid developer is caused by penetration of aliphatic hydrocarbons, a main component of liquid developer. This penetration occurs in a space between molecule chains of a polymeric compound composing the binder resin, thus weakening intermolecular interactions between the molecule chains, or adsorption of aliphatic hydrocarbons into the charge transport agent, which is soluble to the aliphatic hydrocarbons. Additionally, the transmission of the aliphatic hydrocarbon solvent is correlated to permeability of oxygen gas, and use of a surface layer having an oxygen gas permeation coefficient of less than or equal to $5\times10^{-13}$ $cm^3$ (STP)*cm/s*$cm^2$*cmHg could effectively prevent transmission of the aliphatic hydrocarbon solvent.

In the present invention, a permeation coefficient is an intrinsic value defined by Expression (1):

$$\text{Permeation coefficient}=(\text{Transmission flow rate}\times\text{Film thickness})\div\text{Pressure difference} \quad \text{<Expression 1>}$$

The permeation coefficient can be measured by the standard measuring method defined in ASTM-D1432-82 or ASTM-D3985-95. For example, equipment available from MOCON, Co. Ltd. in the trade name of "OX-TRAN" can be effectively used for measurement of the permeation coefficient.

In the electrophotographic photoreceptor for wet development according to the present invention, a surface layer should have an oxygen permeation coefficient of less than or equal to $5\times10^{-13}$ $cm^3$ (STP)*cm/s*$cm^2$*cmHg. Also, it is preferred that the value of the permeation coefficient of the surface layer be as small as possible. Here, $cm^3$ (STP) is a unit of volume of gas under the standard conditions of 0° C. and 1 atmosphere pressure. Such a surface layer can be obtained by forming a uniform coating after mixing a binder resin having a small permeation coefficient with a charge transport material highly compatible with the binder resin. Also, since the permeation coefficient varies depending on the composition or forming condition of a photosensitive layer, the kind of solvent used, or the after treatment, it is necessary to set these conditions to be in the range specified in the present invention.

An electrophotographic photoreceptor for wet development according to the present invention will now be described in more detail.

The electrophotographic photoreceptor includes a photosensitive layer coated on an electrically conductive substrate. The electrically conductive substrate may be a metal or plastic having a thin layer of an electrically conductive material, drum- or belt-shaped support.

The photosensitive layer may be a dual layer type in which a charge generating layer and a charge transport layer are separately laminated, or a single layer having both charge generating and transporting functions.

Examples of the charge generating material used for the photosensitive layer include organic materials such as phthalocyanine pigments, azo pigments, quinone pigments, perylene pigments, indigo pigments, bisbenzoimidazole pigments, quinacridone pigments, azulenium dyes, squarylium dyes, pyrylium dyes, triarylmethane dyes, cyanine dyes, and inorganic materials such as amorphous silicon, amorphous selenium, trigonal selenium, tellurium, selenium-tellurium alloys, cadmium sulfide, antimony sulfide or zinc sulfide. The charge generating materials are not limited to those listed herein, and can be used alone or in combination of two or more kinds of these materials.

In the dual layer type photoreceptor, the charge-generating layer can be formed by dispersing a charge generating material and a binder resin in a solvent and coating the same. The charge-generating layer can also be formed by any of various known methods including vacuum deposition, sputtering, chemical vapor deposition method (CVD). The charge generating material generally has a thickness in the range of 0.1 μm~1.0 μm. If the thickness of the charge generating material is less than 0.1 μm, the sensitivity of the photoreceptor is poor. If the thickness is greater than 1.0 μm, the charging capability and sensitivity of the photoreceptor are lowered.

In the case of a single layer type photoreceptor, a photosensitive layer is prepared by dissolving the charge generating material, the binder resin and a charge transport material in a solvent and coating the resultant product.

Examples of solvents used in the coating technique include organic solvents such as alcohols, ketones, amides, ethers, esters, sulfones, aromatics, halogenated aliphatic hydrocarbons and the like. The alcohols are exemplified by methanol, ethanol, buthanol or isopropyl alcohol. The ketones are exemplified by acetone, methylethylketone or cyclohexanone. The amides are exemplified by N,N-dimethylformamide or N,N-dimethylacetoamide. The esters are exemplified by ethyl acetate or methylacetate. The sulfones are exemplified by dimethylsulfoxide or sulforan. The aromatics are exemplified by benzene, toluene, xylene, monochlorobenzene or dichlorobenzene. The halogenated aliphatic hydrocarbons are exemplified by methylene chloride, chloroform, tetrachlorocarbone or trichloroethane. The amount of the solvent is preferably 2 to 100 parts by weight based on 1 part by weight of nonvolatile of the photosensitive layer forming composition.

In general, durability for liquid developer is ensured when the proportion of the binder resin in the surface layer is high. The proportion of the binder resin contained in the surface layer is in the range of 50~100% by weight, preferably, 60~90% by weight. If the proportion of the binder resin is less than 60% by weight, the bonding strength is insufficient, lowering developer resistance. If the proportion of the binder resin is greater than 90% by weight, the sensitivity is lowered and the residual potential may increase.

The proportion of the charge generating material in the photosensitive layer of single layer type photoreceptor preferably ranges from 0.1 to 20% by weight. If the proportion of the charge generating material is too low, the absorptivity of the photosensitive layer is lowered and loss in radiation energy becomes considerable, resulting in a reduction of sensitivity. If the proportion of the charge generating material is too high, dark decay may increase, resulting in lowering of chargeability.

Examples of the binder resin suitable for the surface layer of the electrophotographic photoreceptor and having a small oxygen gas permeation coefficient include a polymer compound having a biphenylfluorene unit represented by Formula 1 in its main chain:

<Formula 1>

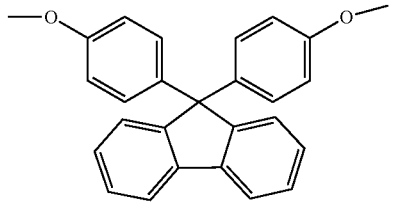

wherein at least one hydrogen atom of the benzene rings can be substituted by an arbitrary substituent selected from the group consisting of a halogen atom, a C1~C20 alkyl group and a C5~C8 cycloalkyl group. The alkyl group is preferably a C1~C7 alkyl group.

Concrete examples of the polymer compound represented by Formula 1 include the following compounds:

<Formula 4>

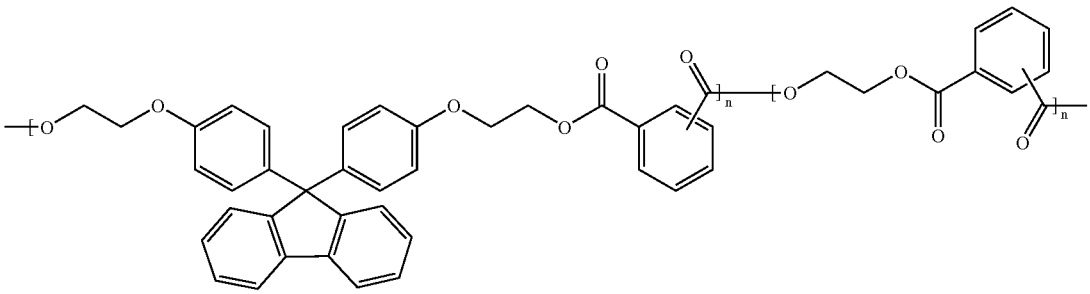

<Formula 5>

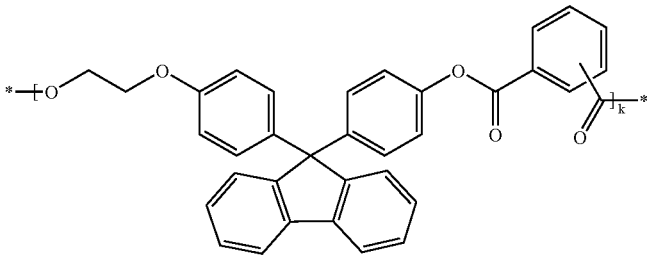

-continued

<Formula 6>

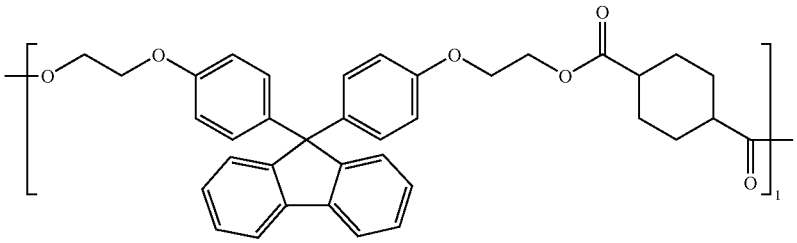

<Formula 7>

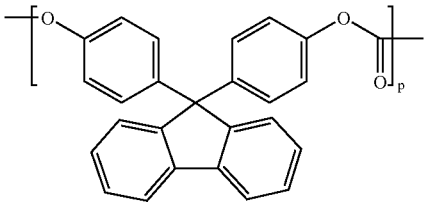

wherein k, l, m, n and p are each an integer between about 10 and about 1000.

Examples of the binder resin useful in the present invention are not limited to those specified above. For example, the resin represented by Formula 1 can be used in combination with other typical binder resin within a range in which the effect of the present invention is not impaired. Examples of the typical binder resin include resins having good gas barrier characteristics among polycarbonate resins exemplified by bisphenol-A type polycarbonate, e.g., PANLITE manufactured by TEIJIN CHEMICAL CO., LTD., or bisphenol-Z type polycarbonate, e.g., IUPILON Z-200 manufactured by MITSUBISHI GAS CHEMICAL CO., LTD.; polyester resins, e.g., Vylon-200 manufactured by TOYOBO CO., LTD., Japan; polystyrene resins, e.g., STYLON manufactured by DOW CHEMICAL CO., LTD.; methacrylic resins, e.g., DIANAL manufactured by MITSUBISHI RAYON CO., LTD.; acrylic resins; polyvinyl chloride; polyvinylidene chloride; polystyrene; polyvinylacetate; silicon resins; silicon-alkyd resins; styrene-alkyd resins; poly-N-vinylcarbazol; phenoxy resins; epoxy resins; phenol resins; polyvinylbutyral resins; polyvinyl acetal resins; polyvinylformal; polysulfones; polyvinyl alcohol; ethyl cellulose; polyamides; carboxymethyl cellulose; and polyurethane resins.

The amount of the binder resin having a repeating unit of biphenylfluorene represented by Formula 1 whose specific examples include the binder resins represented by Formula 4 through 7, preferably ranges from 60 to 90% by weight based on the total weight of the binder used. If the amount of the binder resin having a repeating unit of biphenylfluorene represented by Formula 1 is less than 60% by weight, the bonding strength is insufficient, resulting in poor durability against liquid developer.

In the electrophotographic photoreceptor for wet development according to the present invention, either a hole transport material or an electron transport material may be used as the charge transport material. However, a material having high compatibility with the binder resin and capable of reducing an oxygen gas permeation coefficient of the binder resin is preferred.

Examples of the hole transport material useful in the photosensitive layer include nitrogen-containing cyclic compounds such as pyrene compounds, carbazole compounds, hydrazone compounds, oxazole compounds, oxadiazole compounds, pyrazoline compounds, arylamine compounds, arylmethane compounds, benzidine compounds, thiazole compounds or styryl compounds, condensed polycyclic compounds or mixtures thereof. Polymer compounds having these substituents in their main chains or side chains or polysilane compounds may also be used. In particular, preferred examples of the hole transport material in the electrophotographic photoreceptor according to the present invention include compounds represented by Formula 2:

<Formula 2>

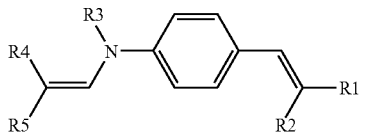

wherein R1 through R5 are each one selected from the group consisting of a hydrogen atom, a C1~C30 substituted or unsubstituted alkyl group, a C6~C30 substituted or unsubstituted aryl group, a C1~C30 substituted or unsubstituted alkoxy group, and a $C_8$~$C_{30}$ substituted or unsubstituted styrile group, and at least one hydrogen atom in the benzene rings can be substituted by an arbitrary substituent. The alkyl group is preferably a C1~C14 substituted or unsubstituted alkyl group, more preferably a C1~C7 substituted or unsubstituted alkyl group. The aryl group is preferably a C6~C21 substituted or unsubstituted aryl group, more preferably a C6~C15 substituted or unsubstituted aryl group. The alkoxy group is preferably a C1~C14 substituted or unsubstituted alkoxy group, more preferably a C1~C7 substituted or unsubstituted alkoxy group. The styryl group is preferably a C8~C21 substituted or unsubstituted styryl group, more preferably a C8~C14 substituted or unsubstituted styryl group.

Concrete examples of the compound represented by Formula 2 include:

<Formula 8>

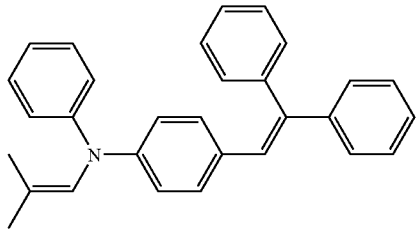

<Formula 9>

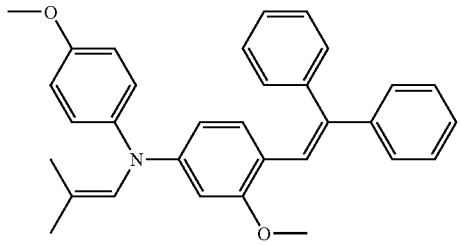

<Formula 10>

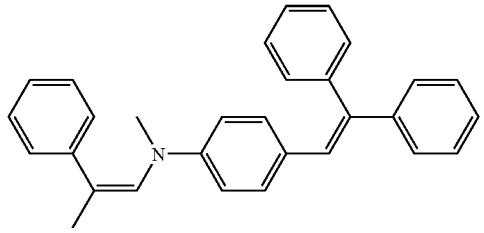

<Formula 11>

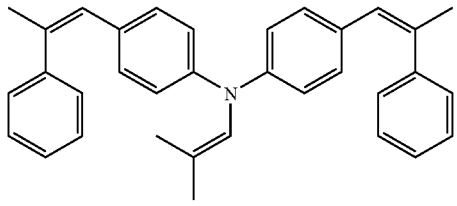

<Formula 12>

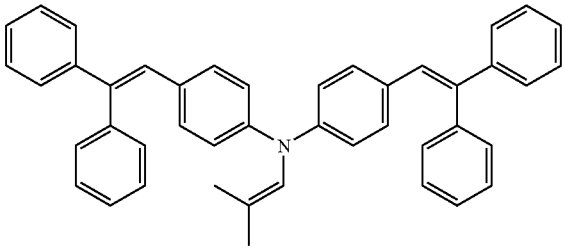

Examples of the electron transport material include electron attracting low-molecular weight compounds such as benzoquinone compounds, cyanoethylene compounds, cyanoquinodimethane compounds, fluorenone compounds, xanthone compounds, phenanthraquinone compounds, phthalic anhydride compounds, thiopyran compounds or diphenoquinone compounds, but are not limited thereto. Electron transporting polymer compounds having these substituents at their main chain or side chain or electron transporting pigments may also be used. Particularly, examples of the electron transport material preferably useful for the electrophotographic photoreceptor for wet development according to the present invention include compounds represented by Formula 3:

<Formula 3>

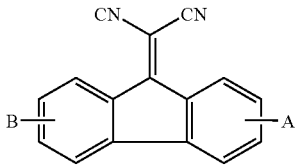

wherein A and B are each selected from the group consisting of a hydrogen atom, a halogen atom, a C2~C30 substituted or unsubstituted alkoxycarbonyl group and a C2~C30 substituted or unsubstituted alkylaminocarbonyl group, and at least one hydrogen atom in the benzene rings can be substituted by a halogen atom. The alkoxycarbonyl group is preferably a C2~C14 substituted or unsubstituted alkoxycarbonyl group, more preferably a C2~C7 substituted or unsubstituted alkoxycarbonyl group. The alkylaminocarbonyl group is preferably a C2~C14 substituted or unsubstituted alkylaminocarbonyl group, more preferably a C2~C7 substituted or unsubstituted alkylaminocarbonyl group.

Concrete examples of the compound represented by Formula 3 include:

<Formula 13>

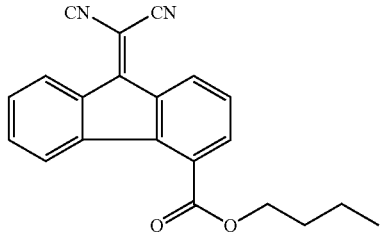

<Formula 14>

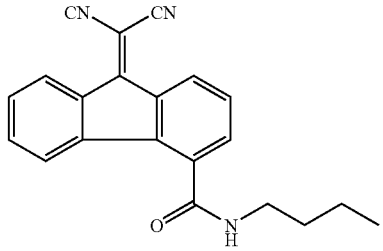

<Formula 15>

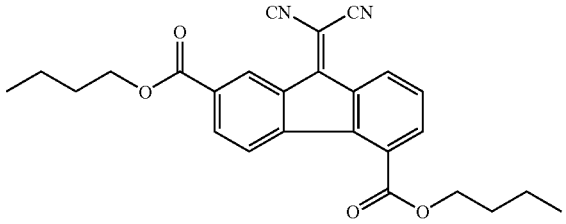

The charge transport material that can be used with the electrophotographic photoreceptor according to the present invention is not limited to those listed herein, and these materials can be used alone or in combination.

In the case of a single layer type photoreceptor where the hole transport material and the electron transport material are used in combination, the proportion of the hole transport material to the electron transport material preferably ranges from 9:1 to 1:3 by weight. If the proportion is out of the range specified above, it is quite difficult to attain enough electron or hole mobility to exhibit appropriate performance as a photoreceptor.

In the photosensitive layer of the electrophotographic photoreceptor for wet development according to the present invention, the amount of the charge transport material including the hole transport material and the electron transport material is preferably in the range of 10 to 40% by weight based on the total weight of the photosensitive layer. If the amount of the charge transport material is less than 10% by weight, the charge transporting capability is insufficient, resulting in poor sensitivity and an undesirable increase in the residual potential. If the amount of the charge transport material is greater than 40% by weight, the proportion of the binder resin contained in the photosensitive layer is small, deteriorating the barrier characteristic of the photosensitive layer, resulting in poor resistance to the liquid developer and weak mechanical strength.

In the dual layer type photoreceptor, the charge transport layer is generally formed by coating a composition obtained by dissolving the charge transport material and the binder resin in a solvent on the charge-generating layer.

In the case of a single layer type photoreceptor, since the charge transport material, the charge generating material and the binder resin are dispersed in the photosensitive layer, charges are generated inside the photosensitive layer. Thus, the photosensitive layer is preferably capable of transporting both holes and electrons. For this reason, the charge transport material is preferably used in combination with a hole transport material and an electron transport material.

The photosensitive layer generally has a thickness in the range of 5 μm~50 μm, irrespective of whether it is of a dual layer type or single layer type. Also, an intermediate layer may be installed between the electrically conductive substrate and a photosensitive layer for the purpose of enhancing adhesion or preventing charges from being injected from the support. Examples of the intermediate layer include, but are not limited to, an aluminum anodized layer, a resin layer dispersed with metal oxide powder such as titanium oxide or tin oxide, and a resin layer such as polyvinyl alcohol, casein, ethylcellulose, gelatin, phenolic resins or polyamides.

Also, the photosensitive layer may contain a plasticizer, a leveling agent, a dispersion-stabilizing agent, an antioxidant or a light-stabilizing agent in addition to the binder resin. Examples of the antioxidant include phenol compounds, sulfur compounds, phosphorus compounds or amine compounds. Examples of the light-stabilizing agent include benzotriazol compounds, benzophenone compounds, or hindered amine compounds.

The present invention will now be described in more detail with reference to specific aspects. The following examples are provided for illustration only and the invention is not limited thereto.

EXAMPLE 1

3 parts by weight of γ-titanyl phthalocyanine (γ-TiOPc), 2 parts by weight of a polyester resin represented by Formula 4 (O-PET, Kanebo)) (m/n=7/3, Mw=50000), and 45 parts by weight of chloroform were mixed and milled using a sand mill for one hour to give a dispersion.

Next, 20 parts by weight of a hole transport material represented by Formula 8, 15 parts by weight of an electron transport material represented by Formula 13 and 65 parts by weight of a polyester resin represented by Formula 4 (O-PET, Kanebo)) (m/n=7/3, Mw=50000) were dissolved in 300 parts by weight of chloroform to give a solution.

The dispersion and the solution were mixed in a ratio of 1:8 by weight and dispersed until the mixture was homogenized forming a coating solution. The coating solution was coated on an aluminum drum having a diameter of 30 mm by a ring coating method, followed by drying at approximately 100° C. for one hour, thereby obtaining a 20 μm thick single layer type electrophotographic photoreceptor.

Also, the same coating solution was coated on a Teflon drum having a diameter of 60 mm under the same conditions and the resultant dry photosensitive layer was peeled off from the drum to prepare a sample for measurement of oxygen gas permeation coefficient. The measurement was performed using a permeation coefficient tester manufactured by MOCON in the trade name of "OX-TRAN", and the result showed that the photosensitive layer had an oxygen gas permeation coefficient of $3.6\times10^{-13}$ $cm^3$ (STP)*cm/s*$cm^2$*cmHg.

COMPARATIVE EXAMPLE 1

A 20 μm thick single layer type electrophotographic photoreceptor was manufactured in the same manner as in Example 1 except that a bisphenol A polycarbonate resin (Panlite C-1400, TEIJIN CHEMICALS LTD) was used instead of a polyester resin represented by Formula 4.

The measurement was performed using the OX-TRAN, and the result showed that the photosensitive layer had an oxygen gas permeation coefficient of $1.3\times10^{-11}$ $cm^3$ (STP) cm/s $cm^2$ cmHg.

EXAMPLE 2

A coating solution prepared in a sand mill by dispersing 7 parts by weight of γ-titanyl phthalocyanine (γ-TiOPc), 3 parts by weight of a polyvinyl butyral resin (S-LEC BH-3, SEKISUI CO., Japan) and 290 parts by weight of ethyl acetate, was coated on an aluminium drum which is the same as that used in Example 1 by a ring coating method, and dried forming a charge generating layer having a thickness of 0.4 μm.

Next, a solution was prepared by dissolving 70 parts by weight of a polyester resin represented by Formula 5 (ISARYL 25S, Isonova), and 30 parts by weight of a hole transport material represented by Formula 11 in 300 parts by weight of chloroform. The solution was then coated on the charge generating layer in the same manner as in Example 1, and dried at 100° C. for approximately 1 hour forming a charge transport layer having a thickness of 20 μm, giving a dual layer type electrophotographic photoreceptor.

The measurement was performed using the OX-TRAN, and the result showed that the charge transport layer had an oxygen gas permeation coefficient of $0.89\times10^{-13}$ $cm^3$ (STP)*cm/s* $cm^2$*cmHg.

COMPARATIVE EXAMPLE 2

A dual layer type electrophotographic photoreceptor having a 20 μm thick charge transport layer was manufactured in the same manner as in Example 2 except that polycarbonate Z resin (lupilon Z-200, MITSUBISHI GAS CHEMICAL CO., Japan) was used instead of a polyester resin represented by Formula 5.

The measurement was performed using the OX-TRAN, and the result showed that the charge transport layer had an oxygen gas permeation coefficient of layer $9.5\times10^{-12}$ $cm^3$ (STP)* cm/s*$cm^2$*cmHg.

Performances of the electrophotographic photoreceptors prepared in Examples 1~2 and Comparative Examples 1~2 were evaluated by the following methods.

Solvent Soaking Test

In order to evaluate resistance against liquid developer of each photoreceptor prepared above, the photoreceptor was dipped in a 500 ml container containing a paraffinic solvent having aliphatic hydrocarbon as a main component (Isopar L, EXXON CHEMICAL CO.) and allowed to stand at room temperature (25° C.) for 10 days. Then, the appearance of the photoreceptor surface and a change in the solvent were observed. The observation results are shown in Table 1.

TABLE 1

| Sample | Oxygen gas permeation coefficient ($cm^3$ (STP) * cm/s * $cm^2$ * cmHg) | Change in photosensitive layer | Change in solvent |
|---|---|---|---|
| Example 1 | $3.6 \times 10^{-13}$ | No change | No change |
| Comparative Example 1 | $1.3 \times 10^{-11}$ | Cracks generated on the whole surface, slightly bleached | Turned brown |
| Example 2 | $0.89 \times 10^{-13}$ | No change | No change |
| Comparative Example 2 | $9.5 \times 10^{-12}$ | Cracks generated on the whole surface | Turned yellow |

Electrostatic Properties

Electrophotographic characteristics of the respective photoreceptors prepared above were measured using a PDT-2000 machine manufactured by QEA.

In the case of single layer type photoreceptors, a corona voltage+7.5 kV was applied for charging. In the case of dual layer type photoreceptors, a corona voltage−7.5 kV was applied for charging. In both cases, charging was performed with a relative speed of a charger and a photoreceptor being 100 mm/sec, immediately followed by irradiating monochrome light having a wavelength of 780 nm at an exposure energy in the range between 0 and 10 mJ/$m^2$. Then, surface potential values after exposure were recorded and compared with the exposure energy to investigate the relationship between the exposure energy and surface potential. Here, $V_0$(V) is a surface potential without light irradiation. $V_i$(V) is a surface potential after exposure with light irradiation of 10 mJ/$m^2$. Energy required for $V_0$ decaying to a half value by irradiation is denoted by $E_{1/2}$(mJ/$m^2$). The measurement results before and after dipping are shown in Table 2.

TABLE 2

| | $V_0$ (V) | | $V_i$ (V) | | $E_{1/2}$ [mJ/$m^2$] | |
|---|---|---|---|---|---|---|
| | Before dipping | After dipping | Before dipping | After dipping | Before dipping | After dipping |
| Example 1 | 652 | 664 | 34 | 38 | 1.56 | 1.59 |
| Comparative Example 1 | 670 | 681 | 41 | 157 | 1.55 | 3.45 |
| Example 2 | −716 | −720 | −15 | −18 | 1.26 | 1.31 |
| Comparative Example 2 | −728 | −765 | −11 | −94 | 1.22 | 2.69 |

As shown in Tables 1 and 2, the photoreceptors prepared in Comparative Example 1 and 2 whose oxygen gas permeation coefficient of each surface layer was greater than $5.0\times10^{-13}$ $cm^3$(STP)*cm/s*$cm^2$*cmHg while exhibiting good electrophotographic characteristics at an initial stage, had poor durability against the solvent used for liquid developer. Also, the charge transport material after soaking was extracted from the photosensitive layer and cracks were generated at the photosensitive layer due to erosion, resulting in considerable deterioration in electrophotographic characteristics. On the other hand, photoreceptors prepared in Examples 1 and 2 had good initial characteristics and were not affected by erosion after soaking, so that little change in electrophotographic characteristic was observed. Therefore, the photoreceptors according to the present invention can be used for where liquid developer is directly contacting the surfaces thereof, without erosion. Also, according to the present invention, since the developer is not contaminated, a stable developing state can be maintained.

As described above, the electrophotographic photoreceptor for wet development according to the present invention has high durability for liquid developer used in a wet development technique and can produce good image characteristics. Therefore, use of the electrophotographic photoreceptor according to the present invention produces effective and practical electrophotographic imaging apparatuses.

FIG. 1 is a block diagram (not to scale) illustrating an electrophotographic photoreceptor 10 including an organic photosensitive layer 2 formed on an electrically conductive substrate 1. A surface layer 3 of the organic photosensitive layer 2 includes a binder resin including a polymer compound and a charge transport material including a low molecule compound. The electrophotographic photoreceptor 10 may also include an intermediate layer 4 between the electrically conductive substrate 1 and the organic photosensitive layer 2.

Figure 2:
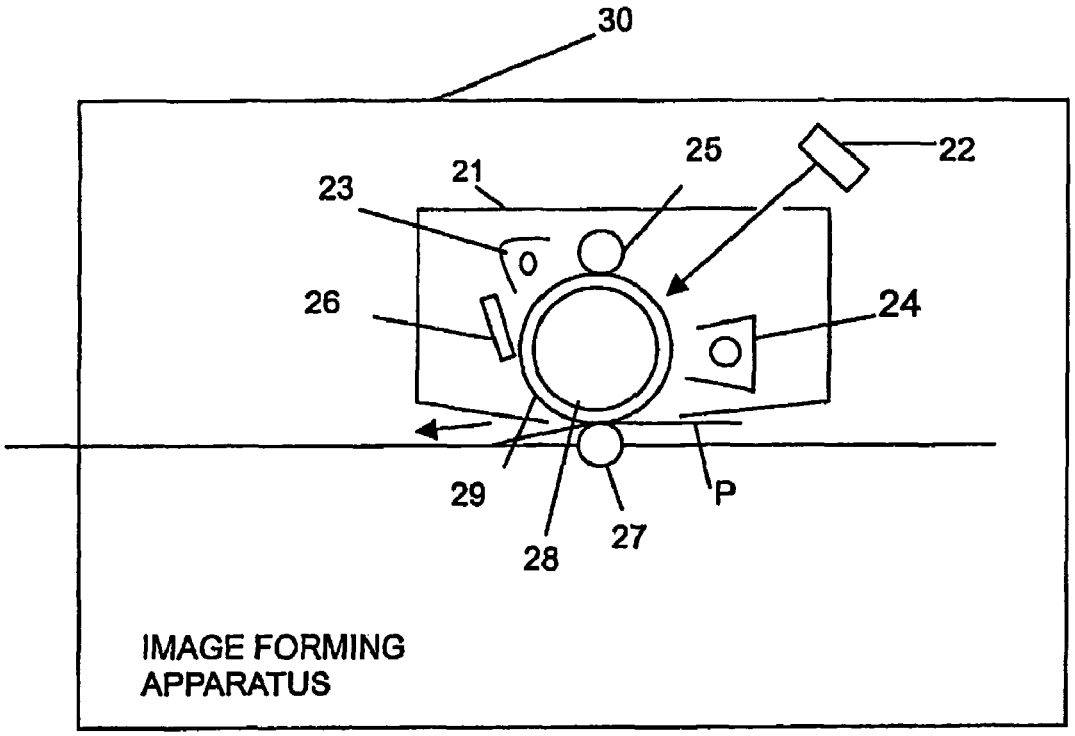
FIG. 2 is a schematic representation of an image forming apparatus, an electrophotographic drum, and an electrophotographic cartridge in accordance with selected embodiments of the present invention.

FIG. 2 is a schematic representation of an image forming apparatus 30. The electrophotographic imaging apparatus 30 includes a photoreceptor unit. The photoreceptor unit generally includes a drum 28 that is attachable to and detachable from the electrophotographic apparatus 30, and an electrophotographic photoreceptor 29 disposed on the drum 28. The imaging apparatus further includes a charging device 25 which charges the photoreceptor unit, an imagewise light irradiating device 22 which irradiates the charged photoreceptor unit with imagewise light to form an electrostatic latent image with a toner to form a toner image on the photoreceptor unit, and a transfer device 27, which transfers the toner image onto a receiving material, such as paper P. The charging device 25 may be supplied with a voltage as a charging unit and may contact and charge the electrophotographic photoreceptor 29. Where desired, the apparatus may also include a pre-exposure unit 23 to erase residual charge on the surface of the electrophotographic photoreceptor 29 to prepare for a next cycle. The imaging apparatus further includes an electrophotographic cartridge 21, a developing device 24 which develops an electrostatic latent image formed on the electrophotographic photoreceptor 29, and a cleaning device 26 which cleans a surface of the electrophotographic photoreceptor 29.

While the present invention has been particularly shown and described with reference to aspects thereof, it will be understood by those of ordinary skill in the art that various changes in form and details may be made therein without departing from the spirit and scope of the present invention as defined by the appended claims.

What is claimed is:

1. An electrophotographic photoreceptor for wet development comprising:

an electrically conductive substrate; and an organic photosensitive layer formed on the electrically conductive substrate, wherein a surface layer of the organic photosensitive layer includes at least a binder resin comprising a polymer compound and a charge transport material comprising a low molecule compound, the surface layer having an oxygen gas permeation coefficient of $5\times10^{-13}$ $cm^3(STP)*cm/s*cm^2*cmHg$ or less.

2. The electrophotographic photoreceptor of claim 1, wherein the binder resin is formed of a polymer compound having a biphenylfluroene unit represented by Formula 1 in a main chain:

<Formula 1>

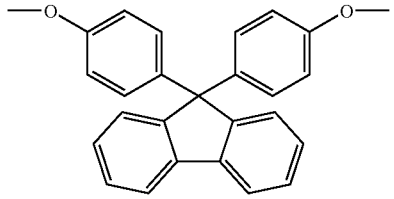

wherein at least one hydrogen atom of the benzene rings is substitutable by an arbitrary substituent selected from the group consisting of a halogen atom, a C1~C20 alkyl group and a C5~C8 cycloalkyl group.

3. The electrophotographic photoreceptor of claim 1, wherein the charge transport material includes a hole transport material represented by Formula 2:

<Formula 2>

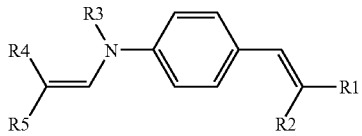

wherein R1 through R5 are independently one selected from the group consisting of a hydrogen atom, a C1~C30 substituted or unsubstituted alkyl group, a C6~C30 substituted or unsubstituted aryl group, a C1~C30 substituted or unsubstituted alkoxy group, and a C8~C30 substituted or unsubstituted styrile group, and at least one hydrogen atom in the benzene rings is substitutable by an arbitrary substituent.

4. The electrophotographic photoreceptor of claim 1, wherein the charge transport material includes an electron transport material represented by Formula 3:

<Formula 3>

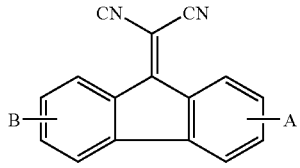

wherein A and B are independently one selected from the group consisting of a hydrogen atom, a halogen atom, a C2~C30 substituted or unsubstituted alkoxycarbonyl group and a C2~C30 substituted or unsubstituted alkylaminocarbonyl group, and at least one hydrogen atom in the benzene rings is substitutable by a halogen atom.

5. The electrophotographic photoreceptor of claim 1, wherein a proportion of the binder resin in the surface layer is preferably 60~90% by weight.

6. The electrophotographic photoreceptor of claim 2, wherein the polymer compound is represented by Formula 4, 5, 6 or 7:

<Formula 4>

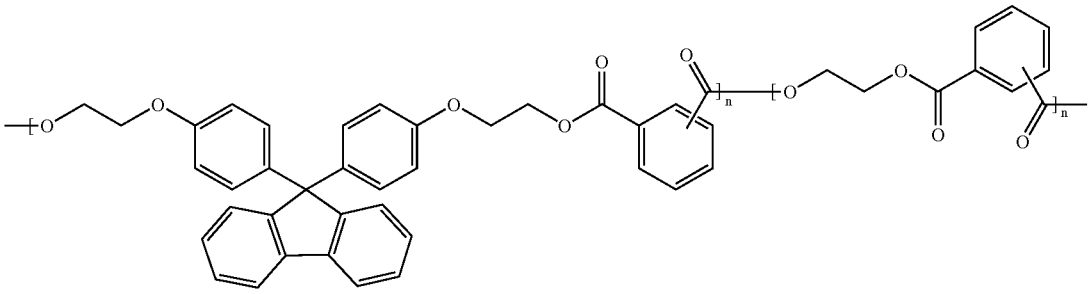

<Formula 5>

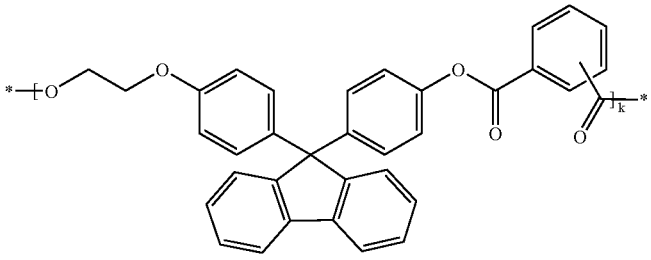

-continued

<Formula 6>

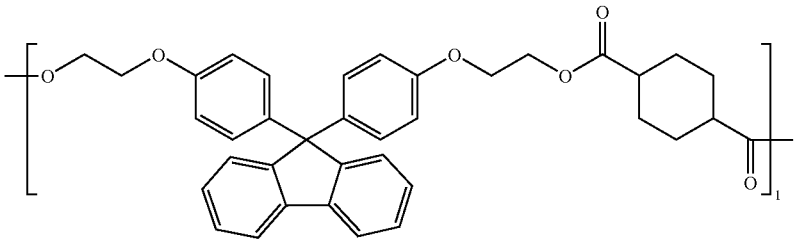

<Formula 7>

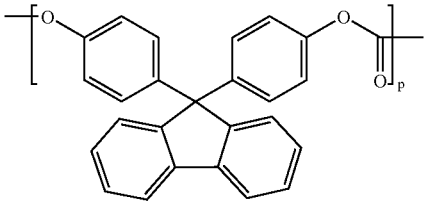

wherein k, l, m, n and p are independently an integer between about 10 and about 1000.

7. The electrophotographic photoreceptor of claim 1, wherein the electrophotographic photoreceptor further comprises an intermediate layer for enhancing bonding strength of the organic photosensitive layer to the electrically conductive substrate.

8. The electrophotographic photoreceptor of claim 1, wherein the electrophotographic photoreceptor further comprises an intermediate layer for preventing charge injection from the electrically conductive substrate, between the electrically conductive substrate and the photosensitive layer.

9. An electrophotographic imaging apparatus comprising:

a developing unit utilizing liquid developer, wherein the liquid developer is able to directly contact the surface of an electrophotographic photoreceptor comprising an organic photosensitive layer formed on an electrically conductive substrate, wherein a surface layer of the organic photosensitive layer includes at least a binder resin comprising a polymer compound and a charge transport material comprising a low molecule compound, the surface layer having an oxygen gas permeation coefficient of $5\times10^{-13}$ $cm^3(STP)*cm/s*cm^2*cmHg$ or less.

10. The electrophotographic imaging apparatus of claim 9, wherein the binder resin is formed of a polymer compound having a biphenylfluorene unit represented by Formula 1 in a main chain:

<Formula 1>

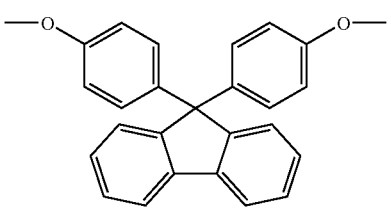

wherein at least one hydrogen atom of the benzene rings is substitutable by an arbitrary substituent selected from the group consisting of a halogen atom, a C1~C20 alky I group and a C5~C8 cycloalkyl group.

11. The electrophotographic imaging apparatus of claim 9, wherein the charge transport material includes a hole transport material represented by Formula 2:

<Formula 2>

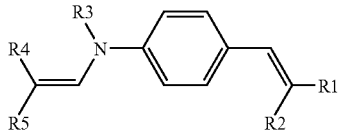

wherein R1 through R5 are independently one selected from the group consisting of a hydrogen atom, a C1~C30 substituted or unsubstituted alkyl group, a C6~C30 substituted or unsubstituted aryl group, a C1~C30 substituted or unsubstituted alkoxy group, and a C8~C30 substituted or unsubstituted styrile group, and at least one hydrogen atom in the benzene rings is substitutable by an arbitrary substituent.

12. The electrophotographic imaging apparatus of claim 9, wherein the charge transport material includes an electron transport material represented by Formula 3:

<Formula 3>

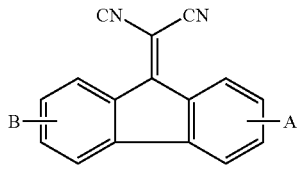

wherein A and B are independently selected from the group consisting of a hydrogen atom, a halogen atom, a C2~C30 substituted or unsubstituted alkoxycarbonyl group and a C2~C30 substituted or unsubstituted alkylaminocarbonyl group, and at least one hydrogen atom in the benzene rings is substitutable by a halogen atom.

13. The electrophotographic imaging apparatus of claim 9, wherein a proportion of the binder resin in the surface layer is preferably 60~90% by weight.

14. The electrophotographic imaging apparatus of claim 9, wherein the polymer compound is represented by Formula 4, 5, 6 or 7:

<Formula 4>

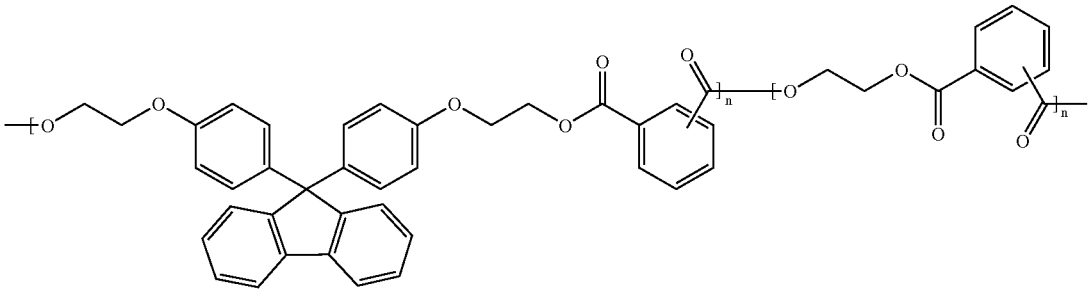

<Formula 5>

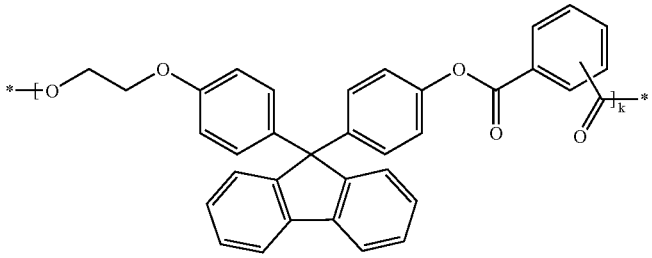

<Formula 6>

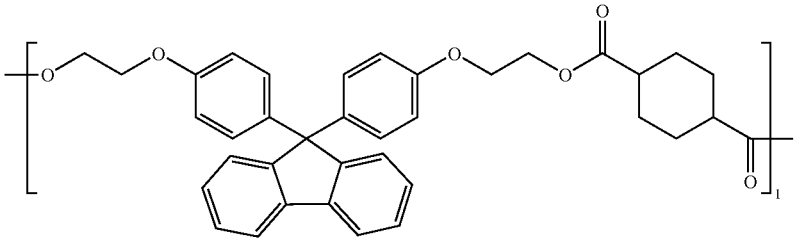

<Formula 7>

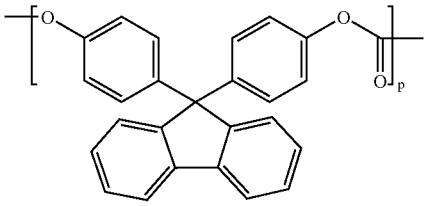

wherein k, l, m, n and p are independently an integer between about 10 and about 1000.

15. The electrophotographic imaging apparatus of claim 9, wherein the electrophotographic photoreceptor further comprises an intermediate layer for enhancing bonding strength of the organic photosensitive layer to the electrically conductive substrate.

16. The electrophotographic imaging apparatus of claim 9, wherein the electrophotographic photoreceptor further comprises an intermediate layer for preventing charge injection from the electrically conductive substrate, between the electrically conductive substrate and the photosensitive layer.

17. An electrophotographic cartridge, comprising:

an electrophotographic photoreceptor comprising an organic photosensitive layer formed on an electrically conductive substrate, wherein a surface layer of the organic photosensitive layer includes at least a binder resin comprising a polymer compound and a charge transport material comprising a low molecule compound, the surface layer having an oxygen gas permeation coefficient of $5\times10^{-13}$ $cm^3(STP)*cm/s*cm^2*cmHg$ or less;

a charging device that charges the electrophotographic photoreceptor;

a developing device which develops an electrostatic latent image formed on the electrophotographic photoreceptor; and a cleaning device which cleans a surface of the electrophotographic photoreceptor;

wherein the electrophotographic cartridge is attachable to or detachable from an image forming apparatus.

18. The electrophotographic cartridge of claim 17, wherein the binder resin is formed of a polymer compound having a biphenylfluorene unit represented by Formula 1 in a main chain:

<Formula 1>

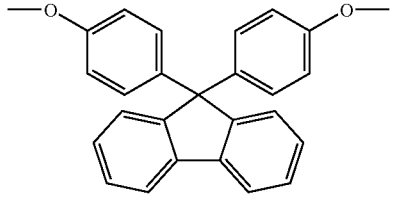

wherein at least one hydrogen atom of the benzene rings is substitutable by an arbitrary substituent selected from the group consisting of a halogen atom, a C1~C20 alky I group and a C5~C8 cycloalkyl group.

19. The electrophotographic cartridge of claim 17, wherein the charge transport material includes a hole transport material represented by Formula 2:

<Formula 2>

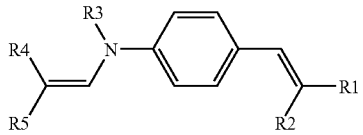

wherein R1 through R5 are independently one selected from the group consisting of a hydrogen atom, a C1~C30 substituted or unsubstituted alkyl group, a C6~C30 substituted or unsubstituted aryl group, a C1~C30 substituted or unsubstituted alkoxy group, and a C8~C30 substituted or unsubstituted styrile group, and at least one hydrogen atom in the benzene rings is substitutable by an arbitrary substituent.

20. The electrophotographic cartridge of claim 17, wherein the charge transport material includes an electron transport material represented by Formula 3:

<Formula 3>

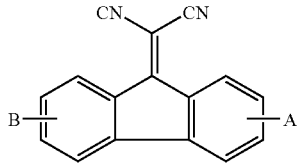

wherein A and B are independently selected from the group consisting of a hydrogen atom, a halogen atom, a C2~C30 substituted or unsubstituted alkoxycarbonyl group and a C2~C30 substituted or unsubstituted alkylaminocarbonyl group, and at least one hydrogen atom in the benzene rings is substitutable by a halogen atom.

21. The electrophotographic cartridge of claim 17, wherein a proportion of the binder resin in the surface layer is preferably 60~90% by weight.

22. The electrophotographic cartridge of claim 17 wherein the polymer compound is represented by Formula 4, 5, 6 or 7:

<Formula 4>

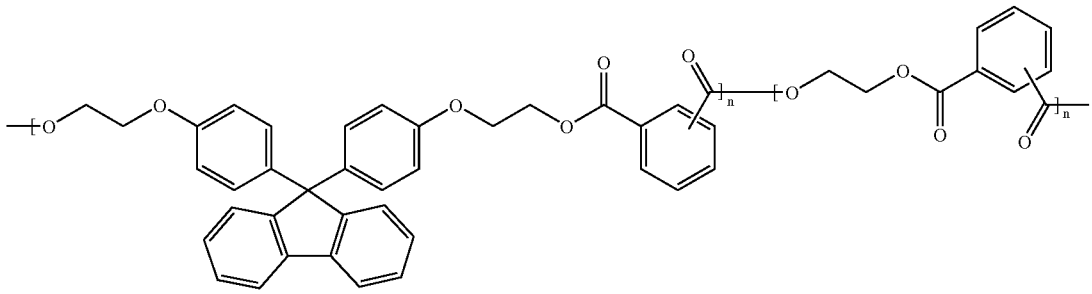

<Formula 5>

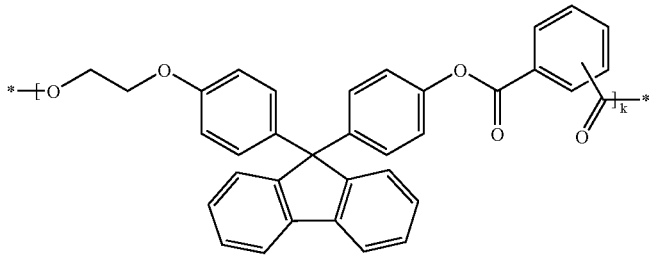

-continued

<Formula 6>

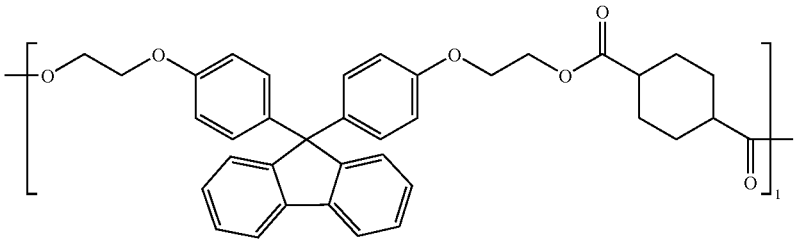

<Formula 7>

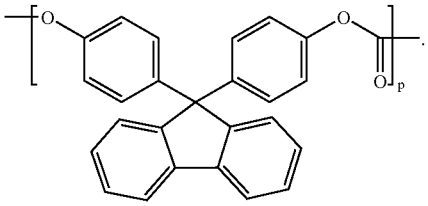

wherein k, l, m, n and p are independently an integer between about 10 and about 1000.

23. The electrophotographic cartridge of claim 17, wherein the electrophotographic photoreceptor further comprises an intermediate layer for enhancing bonding strength of the organic photosensitive layer to the electrically conductive substrate.

24. The electrophotographic cartridge of claim 17, wherein the electrophotographic photoreceptor further comprises an intermediate layer for preventing charge injection from the electrically conductive substrate, between the electrically conductive substrate and the photosensitive layer.

* * * * *

UNITED STATES PATENT AND TRADEMARK OFFICE

CERTIFICATE OF CORRECTION

PATENT NO. : 7,078,139 B2
APPLICATION NO. : 10/680421
DATED : July 18, 2006
INVENTOR(S) : Saburo Yokota et al.

It is certified that error appears in the above-identified patent and that said Letters Patent is hereby corrected as shown below:

Under item (56) References Cited

Title page Column 2 (Other Publications), Line 1, after "(pub" insert --.--.

Column 17, Line 15, change "biphenylfluroene" to --biphenylfluorene--.

Column 19, Line 66-67, change "alky l" to --alkyl--.

Column 23, Line 19-20, change "alky l" to --alkyl--.

Column 24, Line 34, after "claim 17" insert --,--.

Signed and Sealed this

Twentieth Day of February, 2007

JON W. DUDAS
*Director of the United States Patent and Trademark Office*